United States Patent [19]

Vorsmann

[11] Patent Number: 4,995,440

[45] Date of Patent: Feb. 26, 1991

[54] ROLLING SHUTTER FOR WALL OR ROOF OPENINGS, ESPECIALLY IN CONNECTION WITH TURNABLE ROOF WINDOW

[76] Inventor: Franz Vorsmann, Marsberger Str. 14, 3538 Marsberg 4, Fed. Rep. of Germany

[21] Appl. No.: 479,354

[22] Filed: Feb. 13, 1990

[30] Foreign Application Priority Data

Feb. 13, 1989 [DE] Fed. Rep. of Germany ... 8901615[U]
Oct. 11, 1989 [DE] Fed. Rep. of Germany ... 8912065[U]

[51] Int. Cl.[5] ..... E06B 9/26

[52] U.S. Cl. ..... 160/32; 160/133; 49/346

[58] Field of Search ..... 160/133, 32, 61, 68, 160/265, 236, 30, 36; 49/346

[56] References Cited

U.S. PATENT DOCUMENTS

| | | | |
|---|---|---|---|
| 4,365,660 | 12/1982 | Henkenjohann | 160/133 |
| 4,683,932 | 8/1987 | Bubendorff | 160/133 |
| 4,691,753 | 9/1987 | Baier | 160/133 X |
| 4,723,588 | 2/1988 | Ruppel | 160/235 X |
| 4,760,873 | 8/1988 | Bubendorff | 160/133 X |
| 4,846,242 | 7/1989 | Baier | 160/133 X |

*Primary Examiner*—Blair M. Johnson
*Attorney, Agent, or Firm*—Michael J. Striker

[57] ABSTRACT

A rolling shutter for wall or roof openings, especially in connection with a turnable roof window comprises a rolling shutter web composed of a plurality of rolling shutter elements pullable from one another for forming light gaps, a rolling shutter shaft for winding and unwinding of the rolling shutter web, supports for rotatably supporting the rolling shutter web, two parallel side walls connected with the supports for guiding lateral ends of the rolling shutter webs, an actuating device having a mechanism for an opening movement of the rolling shutter web and a pulling device engaging a free front end of the rolling shutter web and supporting or performing its closing movement, the rolling shutter elements including a front rolling shutter element and a rear rolling shutter element, a pulling rope connecting the front rolling shutter element and the rear shutter element, the pulling rope being fixedly connected with the rear rolling shutter element and being connected with the front rolling shutter element by means of a spring provided for closing of the light gaps, the spring having a force selected so that during starting an opening movement of the rolling shutter web at least the light gaps located between the front and rear rolling shutter elements are opened under the action of the pulling device and then the rolling shutter web is wound in an opening direction.

25 Claims, 8 Drawing Sheets

ROLLING SHUTTER FOR WALL OR ROOF OPENINGS, ESPECIALLY IN CONNECTION WITH TURNABLE ROOF WINDOW

BACKGROUND OF THE INVENTION

The present invention relates to a rolling shutter for wall or roof openings, especially in connection with a turnable roof window. More particularly, it relates to such a rolling shutter which has a rolling shutter web composed of a plurality of rolling shutter bars movable from one another to form light gaps, a rolling shaft for winding an unwinding the rolling shutter webs, supports for rotatably supporting the rolling shutter shaft, two parallel side parts connected with the supports and used for guiding the lateral ends of the rolling shutter web, and an actuating device. The latter includes a mechanism for performing the opening movement of the rolling shutter web, and a pulling device engaging the free front end of the rolling shutter web and performing or contributing to its closing movement.

Rolling shutters for roof windows or the like are known in many various embodiments. They serve mainly for closing of roof windows mounted in inclined roof surfaces and including blind frames fixedly mounted in the roof and a window blade turnable or tiltable mainly about a horizontal axis. Such roof windows are usually identified as roof residence window, roof surface window or the like.

In a known rolling shutter of the above mentioned general type, disclosed for example in the German documents DE-OS 2,906,871 and 2,906,913, the pulling device serves the purpose of activating or supporting the closing movement of the rolling shutter for the case when the side parts are arranged not vertically or at least not with such inclination that the rolling shutter web during release of the opening mechanism runs itself to the closing position due to its force of gravity. The pulling device is formed as a special rolling spring. In another known rolling shutter of the above mentioned type disclosed for example in German document DE-GM 8,505,823, the pulling device is formed as a pulling cable which is provided additionally to a pulling cable which forms the opening mechanism, so that by pulling of one of the two pulling cables an opening movement or a closing movement can be performed. Similar devices are also disclosed in other variants for example in the German documents DE-OS 2,802,078; 2,742,787 and 3,507,015.

For all these constructions of the rolling shutters it is common that they cannot provide sufficient safety in that during closing of the rolling shutter the light gaps located between the individual rolling shutters bars, lamellas or the like, are closed. This is true especially when the pulling device engages at the frontmost rolling shutter bar and the rolling shutter must be closed with partially open, approximately horizontal or upwardly inclined window blade. Regardless of this, the known rolling shutters have the tendency to press the closed rolling shutters bars o lamellas from one another in the event of moist frost or snow, thereby ice and snow can accumulate in the light gaps and cause damages to the rolling shutter web. Moreover, the conventionally utilized rolling shutter webs in the case of glaciation or dirtying of the guides provided in the side parts have the tendency of canting laterally, which can also cause damages to the rolling shutter webs.

SUMMARY OF THE INVENTION

Accordingly, it is an object of the present invention to provide a rolling shutter of the above mentioned type which is formed so that even in the event of low roof inclinations or open window blades it provides reliable closing of the rolling shutter web and especially the light gaps, and also is little sensitive to ice, snow and the like.

It is also an object of the present invention to provide such a rolling shutter in which the pulling device can be formed with the utilization of simple means which allow free selection of forces applied by a spring and can be adapted to the requirements of each individual application, so that no further extension of the guiding body is required.

In keeping with these objects and with others which will become apparent hereinafter, one feature of the present invention resides, briefly stated, in that the front and rear ends of the rolling shutter web are connected by at least one pulling cable, the pulling cable is connected at the rear end fixedly and at the front end by means of a spring which determines the light gap for closing, and the force of the spring is selected so that during starting and opening movement of the rolling shutter web, first the light gap is opened by the action of the pulling device and then the rolling shutter web is wound in the opening direction.

When the rolling shutter is designed in accordance with the present invention, it possesses the advantage in that with its individual rolling shutter bars, lamellas and the like, the front and rear ends of the rolling shutter web connected by the pulling cable and the spring are pre-tensioned with one another and therefore pre-tensioned for closing the light gaps. Thereby the light gaps is retained firmly closed with the closed or semi-open rolling shutter web and with absence of outer forces. During opening of the rolling shutter web by rotating the rolling shutter shaft, the light gaps open under the action of the pulling device engaging the front end of the rolling shutter web, so that the rolling shutter bars move away from one another in the manner required for winding on the rolling shutter shaft. The inventive rolling shutter is therefore significantly less susceptible to frost, snow, impurities, etc. than the conventional roller shutters.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
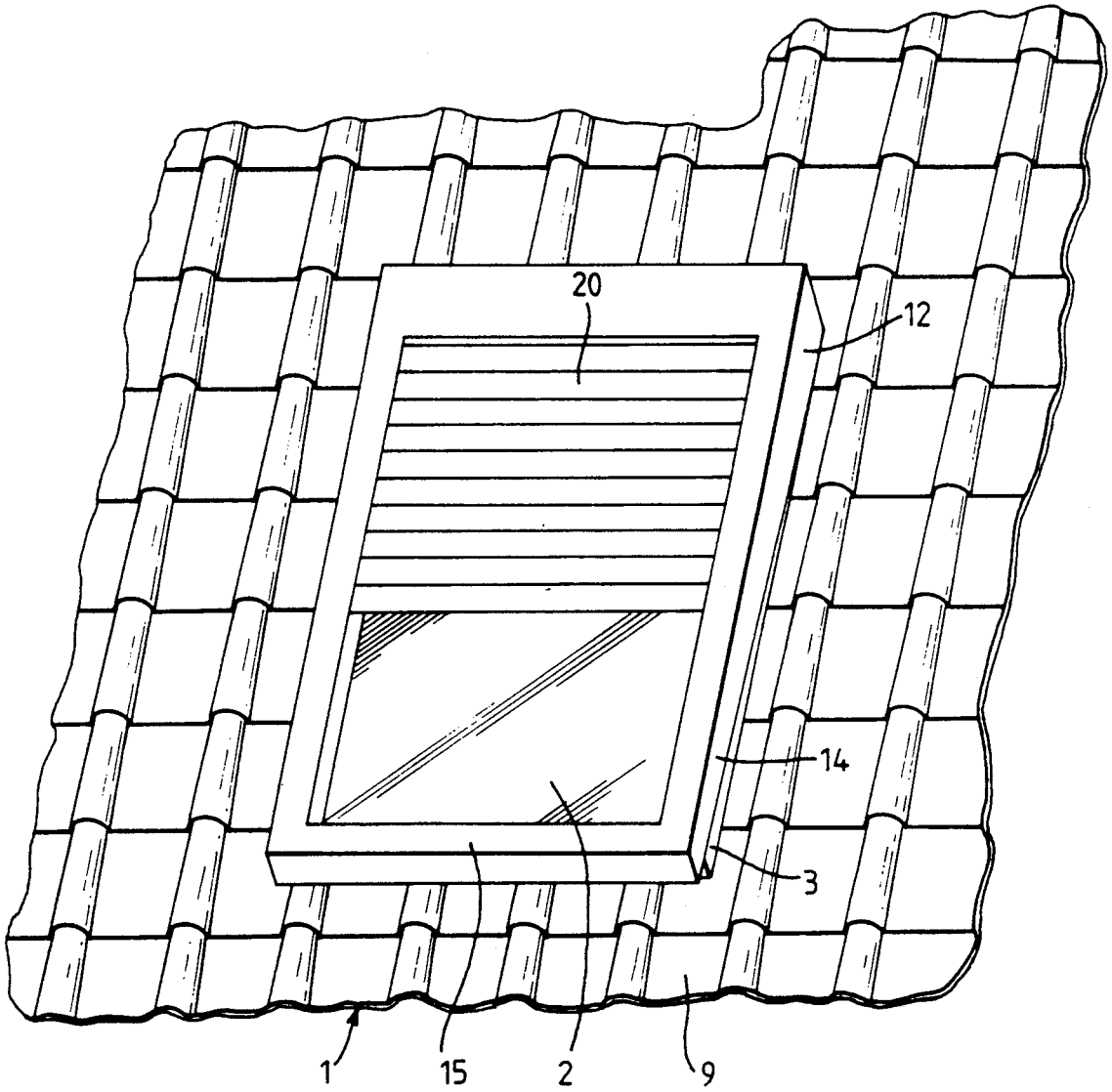
FIG. 1 is a view showing a roof window with an inventive rolling shutter in perspective.

As shown in FIGS. 1–4, a conventional roof window 2 is mounted on a roof 1. It has a blind frame 3 which surrounds a roof opening and a window blade 5 which is supported in the blind frame 3 turnably about a central axis 4. Two lateral supports are rigidly mounted above the blind frame 3 on the roof 1. They are connected with one another for example through a lower blind 7 extending over the width of the blind frame 3 to form a structural unit which is fixed with the roof 1. The lower blind 7 has preferably a portion 8 which is bent rearwardly by 90° and after its mounting on the roof 1 is covered with roof plates 9. Both supports 6 are composed for example of square or rectangular plates with upper edges which are curved along a curve 10 from behind forwardly and downwardly.

Figure 3:
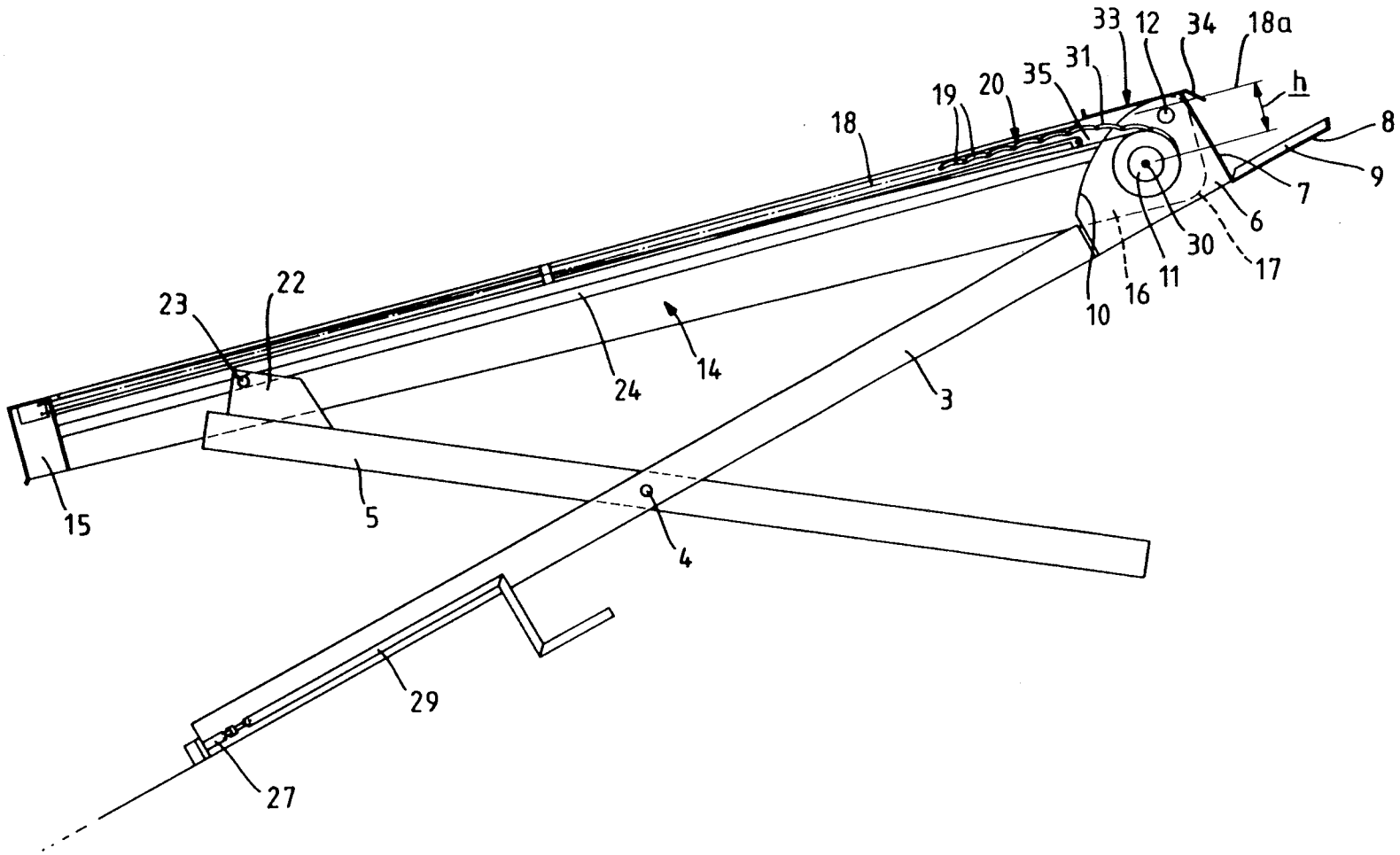
FIG. 3 is a view substantially corresponding to the view of FIG. 2, but showing the opened window blade.

The ends of a rolling shutter shaft 1 arranged between the supports 6 are rotatably supported in the supports 6. Moreover, pivot pins 12 of side parts 14 are turnably supported in the supports 6. The side parts 14 are arranged parallel to one another at a distance corresponding to the distance between the lateral frame parts of the blind frame 3. Their front ends are connected by a foot part 15 arranged perpendicularly to them and formed for example as a hollow body projecting over the associated end of the blind frame 3. The side parts 14 are provided with extensions 16 at their rear ends. The extensions can be composed for example of discs or sheets which cover the supports 6 from outside and extend to the lower blind 7. The side parts 14 and the extensions 16 are formed preferably simultaneously as side blinds, so that together with the foot part 15 they form a frame outwardly surrounding the blind frame 3. The extensions 16 are provided at their lower sides preferably with recesses or rounded corners 17 so that they can perform the turning movements around the pivot pins 12 as shown in FIG. 3.

The side parts 14 are provided at their inner side with upper guides 18 extending parallel to their longitudinal direction and formed as a groove or the like. The lateral ends of a conventional rolling shutter web 20 composed of rolling shutter bars, lamellas 19 or the like shown in FIG. 1 are slidingly guided in the guides 18. The rear end of the rolling shutter web 20 is mounted on a rolling shutter shaft 11. The rear ends of the guides 18 extend in front of the rolling shutter shaft 11 preferably so close to the supports 6, as permitted by the whole construction in individual cases and with consideration of the subsequently described operation.

At least one projection 22 with a guiding pin 23 is mounted on the front end of the window blade 5 which is turned out from the roof 1 during opening of the roof window 2. The guide pin 23 engages in a guiding groove 24 of a side part 14, the guiding groove extending parallel to the longitudinal direction of the side parts. Preferably, such guide pins 23 and such corresponding guiding nuts 24 are provided at both lateral frame parts of the window blade 5 and on both side parts 14 respectively. The combination of the guiding pin 23 and the guiding groove 24 operates so that during opening of the window blade 5 the structural unit composed of the side parts 14, the extensions 16, the foot part 15 is automatically turned in the manner shown in FIG. 4 about the turning pin 12.

The opening and closing movement of the rolling shutter web 20 can be controlled by known rolling shutter actuating devices which are fixedly connected with the rolling shutter shaft 11. Since the rolling shutter shaft 11 is supported in the immovably mounted supports 6 and therefore the turning movement of the side parts 14 is not influenced, the actuating device can be designed in any desirable manner. An actuating element of the actuating device can be guided for example either close to the rolling shutter shaft in the space provided with the roof window 2, or arranged at the opposite end of the roof window 2 with the aid of deviating elements guided along the lateral frame parts of the blind frame 3. This is identified schematically in FIGS. 2 and 3 by a rod which is rotatably supported in the blind frame 3. It leads from a toothed gear transmission engaging the rolling shutter shaft 11 to an actuating element, for example, a crank 29 (FIGS. 2, 4), a pulling cable and the like, which is actuated with opening or closing window blade 5 and from a space. An unintentional sliding of the rolling shutter web 20 out of the guide 18 can be prevented for example by abutments provided on them.

Figure 2:
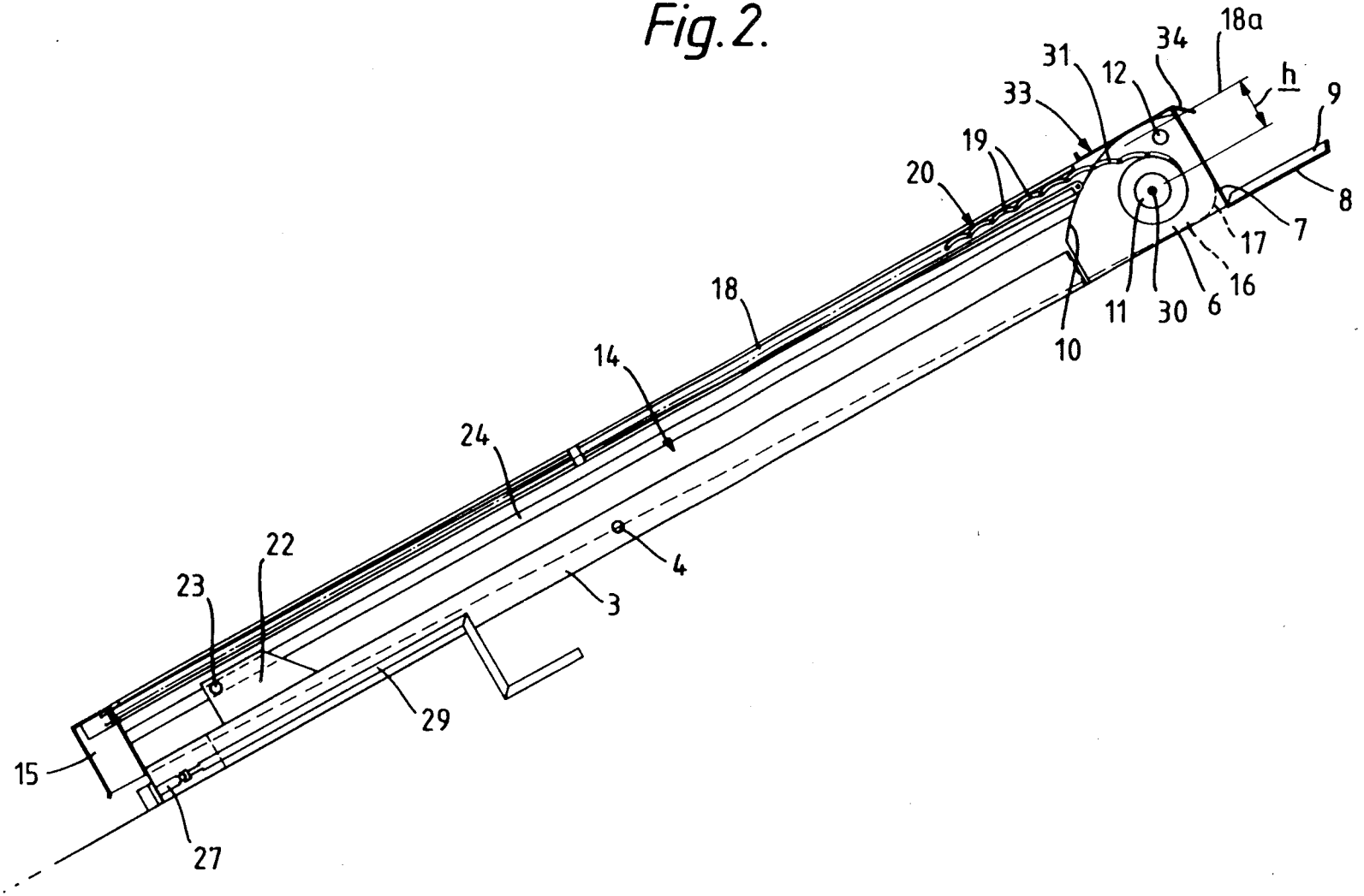
FIG. 2 is a schematic side view of the inventive rolling shutter with a closed window blade.

The operation of the inventive rolling shutter can be recognized from FIGS. 2 and 3. In the closed condition of the window blade 5, the side parts 14 are held in their lower turning position by the guiding pin 23. The rolling shutter web 20 can be arbitrarily wound on or unwound from the rolling shutter shaft 11. The rolling shutter web 20 in the space located between the initial portion of the guides 18 and the rolling shutter shaft 11 describes a convex curve 31 relative to the axis of rotation 30 of the rolling shutter shaft 11. The same is true with the open window blade 5. Therefore it is possible to arbitrarily turn the window blade 5 with closed, partially open or completely open rolling shutter web 20. The condition that during opening of the window blade 5 the distance of the axis 30 of the rolling shutter shaft 11 from respective ends of the guides 18 facing the rolling shutter shaft 11 is gradually somewhat greater has no disadvantage since the piece of the rolling shutter web 20 required for this can be wound also with the completely closed rolling shutter web 20 from a remaining reserve located on the rolling shutter shaft 11. Moreover, many rolling shutter webs 20 are supported in the region of the rolling shutter shaft 11 by so-called spiral springs 21 whereby an available reserve of the rolling shutter web is produced. Regardless of this, the difference in the length of the rolling shutter web 20 produced in the open or closed condition of the window blade can be maintained in the above described construction so small that it amounts only to several centimeters.

For performing the desired function, the side parts 14 are supported by the pivot pin 12 so that the rolling shutter web 20 in all turning positions of the side parts 14 enters the guides along a curve corresponding to the convex curve 31. For this purpose, the position of the pivot pin 20 is preferably selected so that the provided rear extensions 18*a* of the guides (FIGS. 2, 3) have in all these turning positions a substantial distance h from the axis 30, which corresponds at least substantially to the maximum coil radius of the rolling shutter shaft 11 with completely wound rolling shutter web 20. This can be achieved for example in that the pivot pin 12 is arranged in the right upper corner of the supports 6 and simultaneously the axis 30 is arranged substantially in the center of the supports 6. Thereby the portion of the rolling shutter web 20 located between the rolling shutter shaft 11 and the initial portion of the guides 18 in all turning positions is guided on a convex path corresponding substantially to the curve 31, so that an undesired bending of the rolling shutter web 20 upwardly is prevented when the conventional right running arrangement is selected. An undesired pulling out of the rolling shutter web 20 from the guides 18 can be prevented by abutments or the like.

An upper blind 33 with a rear end 34 overlapping the lower blind 7 serves for example for upper coating of the rolling shutter shaft 11. At least a front portion of the upper blind 33 is united with the side parts 14 and the foot part 15 to form a structural unit. Therefore they turn together with the side parts 14 and thereby form a free space 35 required for the above described guidance of the rolling shutter web 20 along the curve 31. Due to the curve 10 on the upper ends of the supports 6, they cannot hinder the turning movement of the upper blind 33. Finally, it can also be seen from FIGS. 2 and 3 that the turning pin 12 can be arranged also at many other locations and especially the location different from the location at which the supports 6 are arranged.

A preferable embodiment of the invention which is favorable for the secure closing of the rolling shutter is illustrated in FIGS. 4–8. This embodiment can be used together with a rolling shutter construction shown in FIGS. 1–3, and also in combination with other conventional roof window rolling shutters and/or in combination with other rolling shutters for example rolling shutters for winter gardens, roof suspends, and the like and window openings having non-vertically arranged blind frames.

Figure 4:
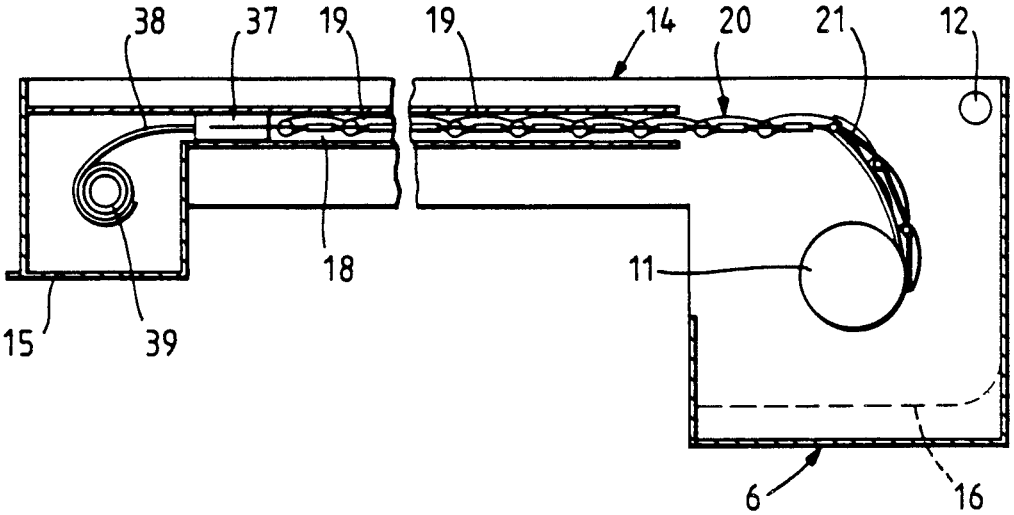
FIG. 4 is a view showing a longitudinal section of rolling shutter of FIG. 2 in accordance with a first embodiment of a pulling device, however, without the roof window and the associated parts, on an enlarged scale.
Figure 5:
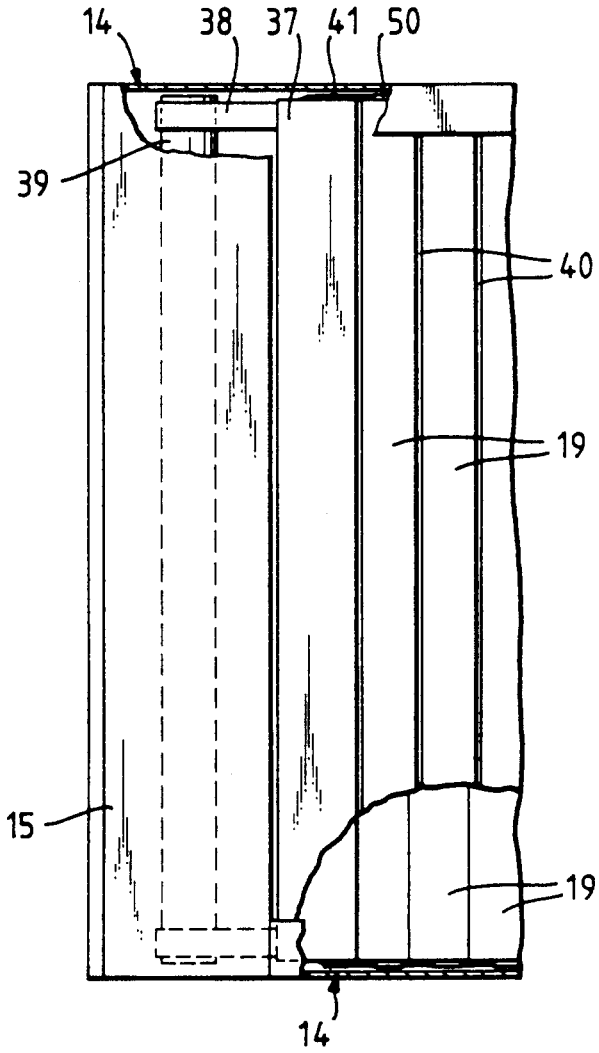
FIG. 5 is a partially sectioned plan view of the rolling shutter of FIG. 4.

In accordance with FIGS. 4 and 5, the front end of the rolling shutter web 20 is formed by a front end bar 37. Pulling bands 38 are mounted on the lateral ends of the end bar 37 and have free ends which are under the action of a pulling device 39 arranged in the foot part 15 and have a a length substantially corresponding to the length of the rolling shutter web 20. The pulling device 39 is formed preferably as a rotatably supported spring shaft with a spring force selected so that the rolling shutter web 20 is pulled in direction of the closing position or in other words in direction of the foot part 15. The operation of the spring shaft is analogous to the operation of conventional spring shafts utilized in inner shades and the like. Therefore, the conventional ratchet device and the like is dispensed with so that the rolling shutter web 20 in each position is under the action of the spring force of the spring shaft. The pulling bands 38 during opening of the rolling shutter are gradually pulled by the spring shaft, during closing of the rolling shutter to the contrary are wound by the spring force again on the spring shaft. The spring force is preferably selected so that substantially uniform pulling forces are produced over the whole movement stroke of the rolling shutter web 20. Instead of the spring shaft,also other pulling devices 29 provided with motors, sliding couplings and the like can be provided.

The rolling shutter web 20 is assembled preferably from conventional rolling shutter bars or lamellas 19 (see especially in FIGS. 5 and 6) which are hooked and pivotally connected with one another and with the end bar 37. Also other constructions can be utilized. Therefore the individual lamellas 19 are displaceable relative to one another in a limited degree parallel to the movement direction of the rolling shutter web 20 so as to form the characteristic light gaps 40 (FIG. 5) which also facilitates or makes possible the winding of the rolling shutter web 20 on the rolling shutter shaft 11. These light gaps 40 are schematically shown in the upper part of the plan view of FIG. 5. In the lower, broken part of FIG. 5 the lamellas 19 without the light gaps 40 directly adjoin one another as required for the closing position.

Figure 6:
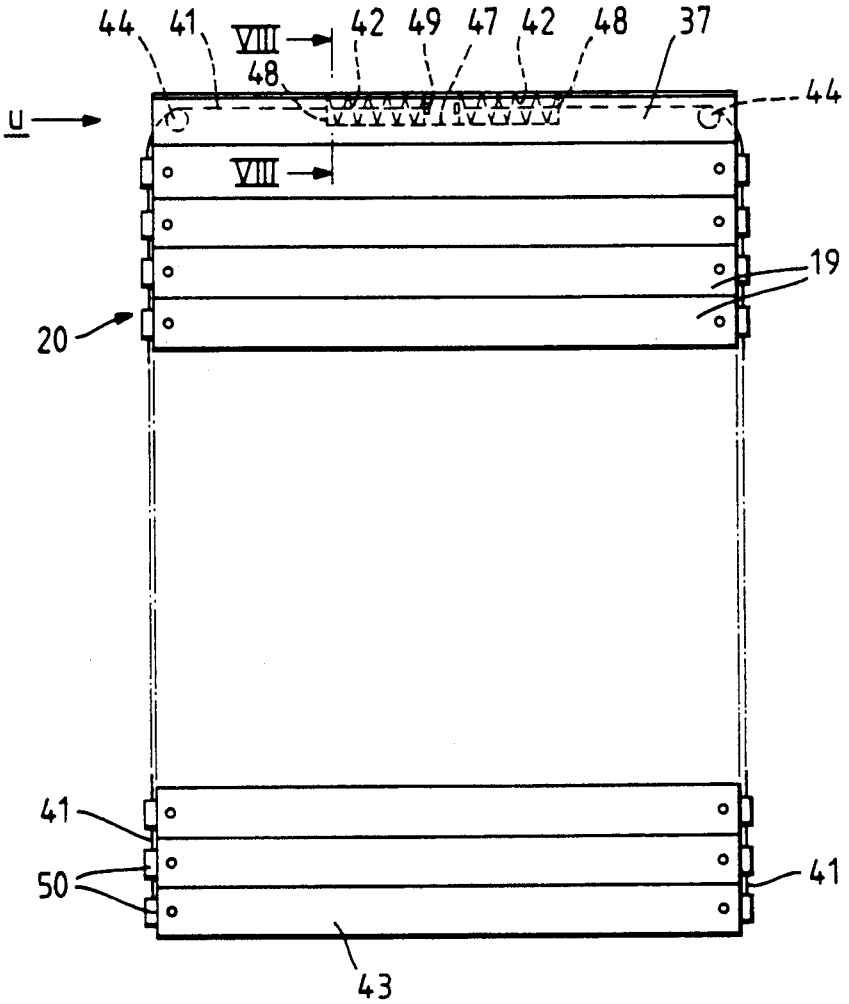
FIG. 6 is a plan view of the rolling shutter web on a scale which is somewhat reduced, as compared with FIGS. 4 and 5.
Figure 7:
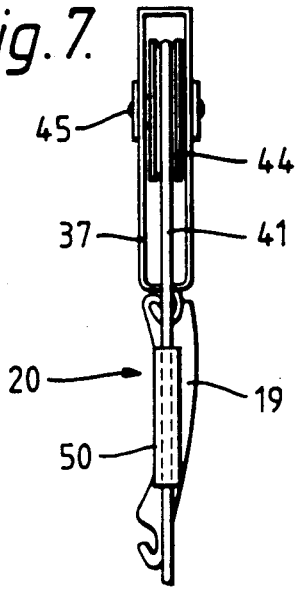
FIG. 7 is a side view of a detail of the rolling shutter web in direction of the arrow u in FIG. 6, on an enlarged scale.
Figure 8:
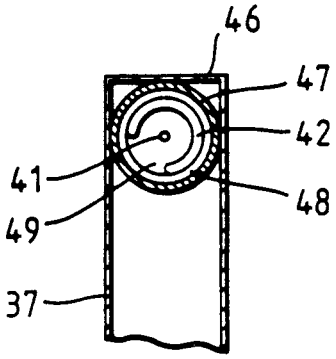
FIG. 8 is a section taken along the line VIII—VIII in FIG. 6, on a substantially enlarged scale.

In accordance with FIGS. 4–7 the front and rear ends of the rolling shutter web 20 are connected at least by a pulling rope or cable 41. Its rear end is connected rigidly and its front end is connected through a spring 42 with the rolling shutter web 20 and can run for example in its central axis. Preferably two such pulling cables 41 is provided, which are arranged at the lateral end of the lamellas 19 and mounted with their rear ends for example on a rear end bar 43 (FIG. 5). The end bar 37 must not be the frontmost end bar and the end bar 43 must not be the last rolling shutter bar 19 of the rolling shutter web 20 since the subsequently described operation can be limited to a preselected number of the following rolling shutter webs 19 arranged between both end bars 37 and 43. The pulling cables are moreover guided over deviating elements 44 located at the front end bar 37 and each composed preferably of a deviating roller rotatably supported in the end bar 37 as shown in FIGS. 6 and 7. The end bar 37 is formed as a hollow body. A bearing pin 45 is mounted in its upper and lower side, and the deviating roller supported between the upper and lower side can rotate on the bearing pin. The axes of the bearing pin 14 extends perpendicularly to the movement direction of the shutter web 20 and perpendicularly to the longitudinal direction of the lamellas 19.

In a central part of the end bar 37, a pipe 47 connected with its walls by rivets 44 or the like is arranged with an axis parallel to its longitudinal direction. A spring 42 is arranged in one half of the pipe 47. Its one end abuts against an end wall 48 provided on the pipe end and its another end abuts against a disc 49 displaceably supported in the pipe 47. A free end of the pulling rope coming from the deviating element 44 and extending through a hole in the end wall 48 is connected with a disc 49. In other half of the pipe 47, a corresponding device for another pulling cable 41 is mounted.

For reliable guidance of the pulling ropes 41, they are preferably slidingly guided in ears 50 which are mounted on the end of the lamellas 19 and formed for example as cylindrical sleevs. The ears 50 are provided on several and preferably all lamellas 19. The pulling cables 41 are preferably composed of wear-resistant and weather-resistant Nirosta wire ropes.

The inventive rolling shutter operates in the following manner

In the completely closed condition of the rolling shutter web 20 it is subjected to the closing action of the pulling device 39 on the one hand. On the other hand, the end bars 37 and 43 are pre-tensioned relative to one another by the springs 42 responsive to the pressure, so that the light gaps 40 are closed or in other words or lamellas 24 tightly abut against one another.

When the light gaps 40 must be opened, this is performed under the action of the actuating device (27 and 29 in FIGS. 2 and 3) on the rolling shutter shaft 11. When the rolling shutter shaft 11 is turned in the winding direction, the end bar 37 is first formly held under the action of the pulling device 39 so that only the lamellas 19 move and thereby the light gaps 40 can be formed, which is simultaneously connected with the stronger pre-tensioning of the springs 42. For this arrangement is designed so that the force of the pulling device 39 or the spring force of the spring shaft which forms the pulling device is greater than the force of springs 42. Then the rolling shutter shaft 11 is turned back, it results in a new closing of the light gaps 40 under the action of the springs 42 which in the preceding opening movement were pre-stressed stronger in the pressing direction and now can be again partially relaxed.

When the rolling shutter web 20 has been partially or completely opened, first the opening of the light gaps 40 is performed in the above described manner. When then the rolling shutter shaft is further turned, the suitably pulled out rolling shutter web 20 is wound on it, while simultaneously the pulling bands 38 are released even more from the spring shaft or pulling device 39. A not shown arresting means associated preferably with the actuating device, the rolling shutter web 20 can be held in each intermediate position. As long as the rolling shutter web 20 is under the action of the pulling device 39, the light gaps 40 remain open, which is favorable for the light winding of the rolling shutter web 20 on the rolling shutter shaft 11. When the rolling shutter shaft 11 at a later time is turned back, the rolling shutter web 20 is pulled in the closing position by the pulling device 30 which is sufficiently pre-tensioned and acts on the end bar 37. Thereby the light gaps 40 are again closed under the action of the spring 42.

The rolling shutter in accordance with the present invention provides for the following advantages:

Due to the springs 42, the rolling shutter web 20 is firmly held in the closing position. Thereby a high sealing action is obtained, which especially counteracts a glaciation and penetration of snow. Further, the rolling shutter remains fully functionable when several lamellas 19 must no longer be in engagement, since their ends are guided on the pulling cables 41. Therefore especially canting of the lamellas 19 in the guides 18 is prevented. As a result, problems with rolling shutters are prevented, which always occur in roof windows formed as roof exits, where the window blades and rolling shutters are additionally supported tiltably about a lateral longitudinal axis. Since a pulling force always acts on the rolling shutter web 20 through the pulling device 39, it is not canted or undesirably rolled on during canting of the rolling shutter. Finally, the pulling device 39 and the springs 42 perform the above described function also with roof windows with low or no inclined position or with roof windows which open outwardly over the horizontal.

The embodiments of FIGS. 9–14 is utilized to avoid the long foot part 15, significantly extending over the front side of the blind frame 3. Here a rolling shutter provided for the turnable roof window and formed substantially in correspondence with the embodiment of FIGS. 1–3 has two supports 51 and one preferably turnable guiding body 52 connected with them. The guiding body 52 is composed of two parallel side parts 53 and 54 and a foot part 55 connecting the free ends of the side parts and arranged perpendicular to them. A rolling shutter shaft 56 is rotatably supported between the supports 51. The rear end of a conventional rolling shutter web 20 is mounted on the rolling shutter shaft 56. The rolling shutter shaft 56 can be reciprocatingly rotated for opening or closing the rolling shutter by a not shown actuating device, such as for example a hand crank or an electric motor and the like through an intermediate transmission in some cases. The lateral ends of the wound parts of the rolling shutter web 20 are guided in lateral guides of the side parts 53 and 54.

The rolling shutter web 20 is formed for example as shown in FIGS. 6 and 7 and assembled from conventional rolling shutter bars, lamellas 19 and the like. The same reference numerals are used for the same parts.

In accordance with FIGS. 9–13, in which the pulling cables 41, the spring 42, the deviating elements 44 are removed for simplification of the drawings, the rolling shutter has a pulling device including at least one further pulling element 61 and a winding device in form of a disc 62. The disc has a preferably cylindrical periphery designed for winding of the pulling element 61. The pulling element 61 is composed for example of a cable especially wire cable, or also from a band, while the disc 62 is formed preferably as a grooved disc and provided for example in its periphery with a nut 63. The pulling element 61 can be wound in several layers or spirally only one layer in the nut and simultaneously secured from lateral sliding out.

Figure 12:
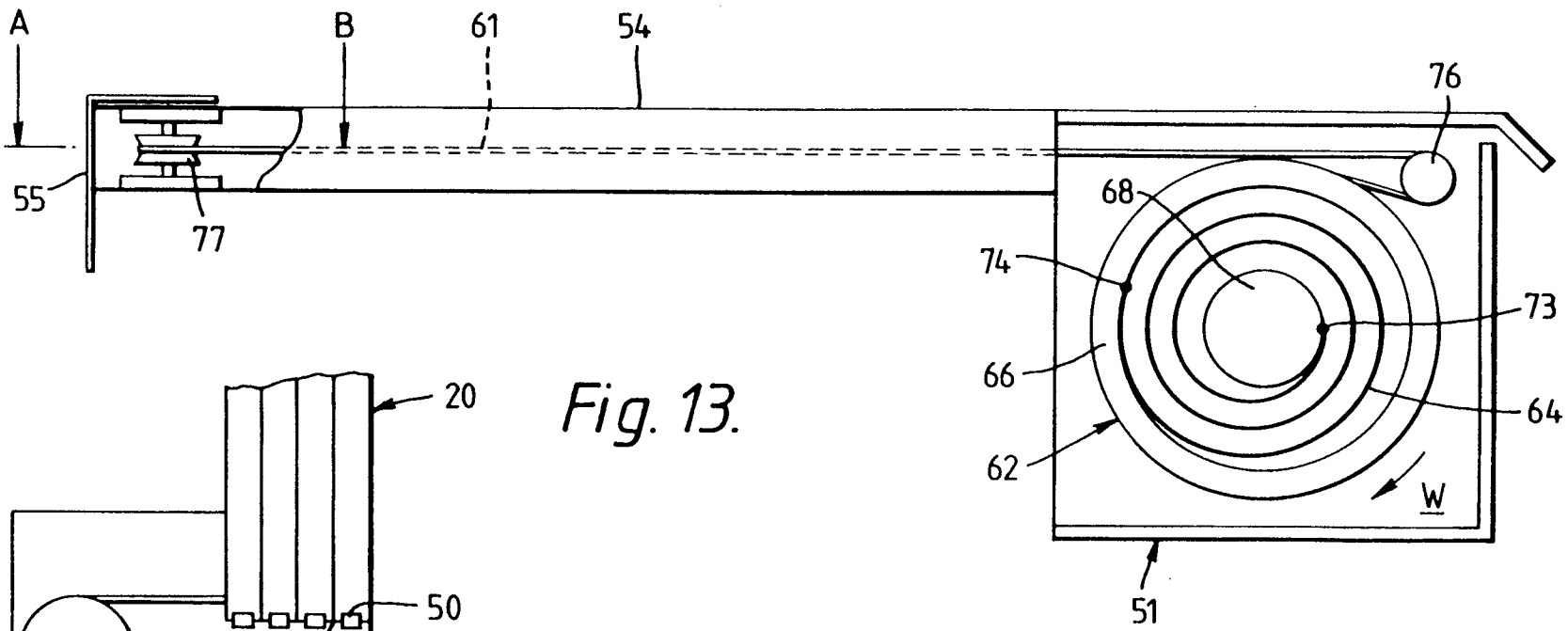
FIG. 12 is a schematic side view as seen in direction of the arrow x in FIG. 9.
Figure 13:
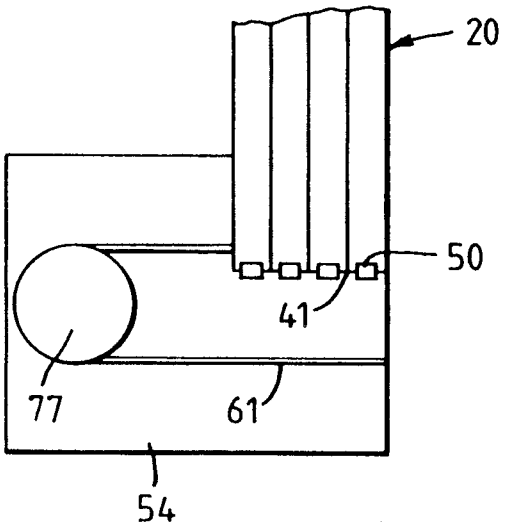
FIG. 13 is a view showing a section taken along the line A–B in FIG. 12, on an enlarged scale.
Figure 14:
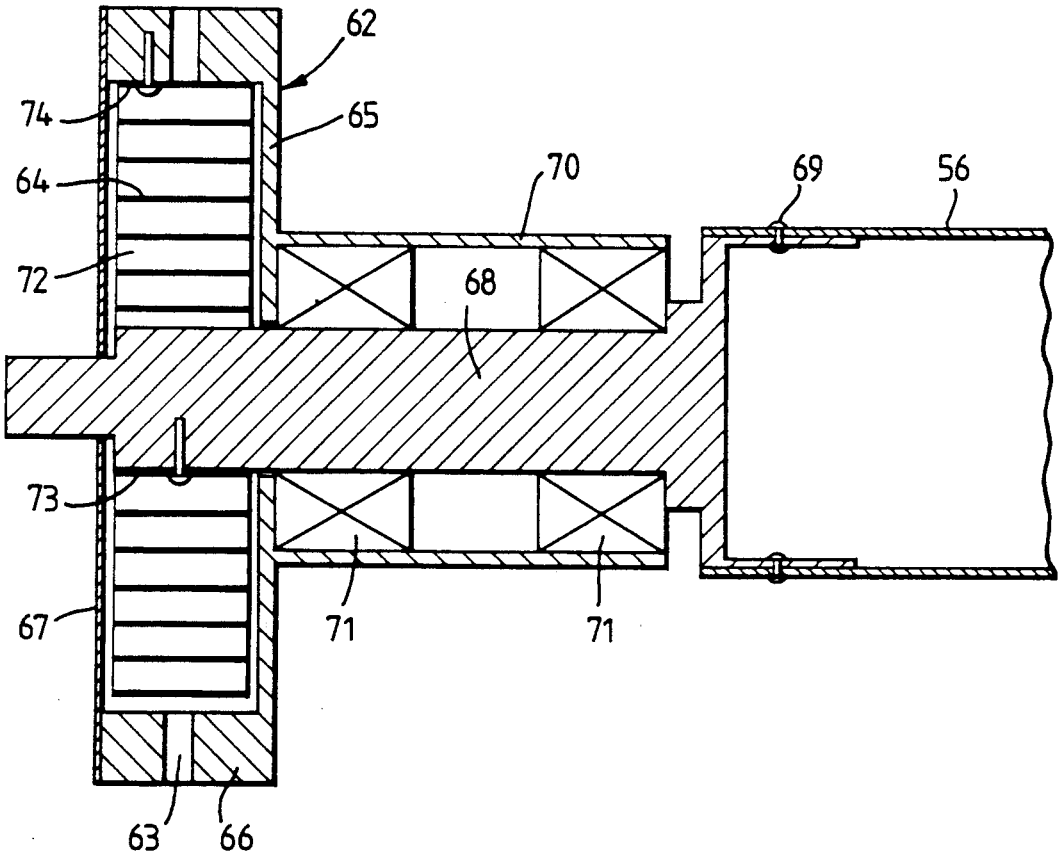
FIG. 14 is a schematic section through a preferable embodiment of a winding device of the invention pulling device on a scale which is substantially enlarged as compared with FIG. 9.

In accordance with FIGS. 12 and 14, the disc 62 is coupled with the rolling shutter shaft 56 through a spring 64 and arranged coaxially with it. As can be seen particularly from FIG. 14, the disc 62 is preferably box-shaped and provided with a bottom 65 arranged perpendicularly to the rolling shaft 56 and connected with a hollow cylindrical wall portion 66. The wall portion 66 forms the periphery of the disc 62 and has a groove 63. A cover 67 is releasably mounted on the wall portion 66 at its end facing away of the bottom 65. Central openings are formed in the bottom 65 and the cover 67 for rotatable insertion of the disc 62 on the one end of the rolling shutter shaft 56. The rolling shutter shaft 56 is formed with its end preferably as a cylindrical bearing pin 68. It can be also formed as a separate part mounted on the rolling shutter shaft 56 by a rivet 69 or the like.

For insuring a smooth rotatability of the disc 62 relative to the rolling shutter shaft 56, a hub 70 is provided on the side of the bottom 65 opposite to the wall portion 66. The hub is supported on the bearing pin 68 by ball bearings 71. The arrangement is preferably selected so that the cover 67 is located on the axially outer end of the disc 62.

The spring 64 is mounted in a hollow space 72 which is formed by the bottom 65, the wall portion 66 and the cover 67. Its one end 73 is connected with the bearing pin 68 while its another end 74 is connected to the wall portion 66. As can be especially seen from FIG. 12, in which the disc 62 is shown on a scale enlarged relative to FIG. 9 and the cover 67 is not shown, the spring 64 is formed preferably as a spiral spring surrounding the bearing pin 68. Therefore the spring 64 can be tensioned or relaxed by relative rotation between the disc 62 and the rolling shutter shaft 56.

Figure 9:
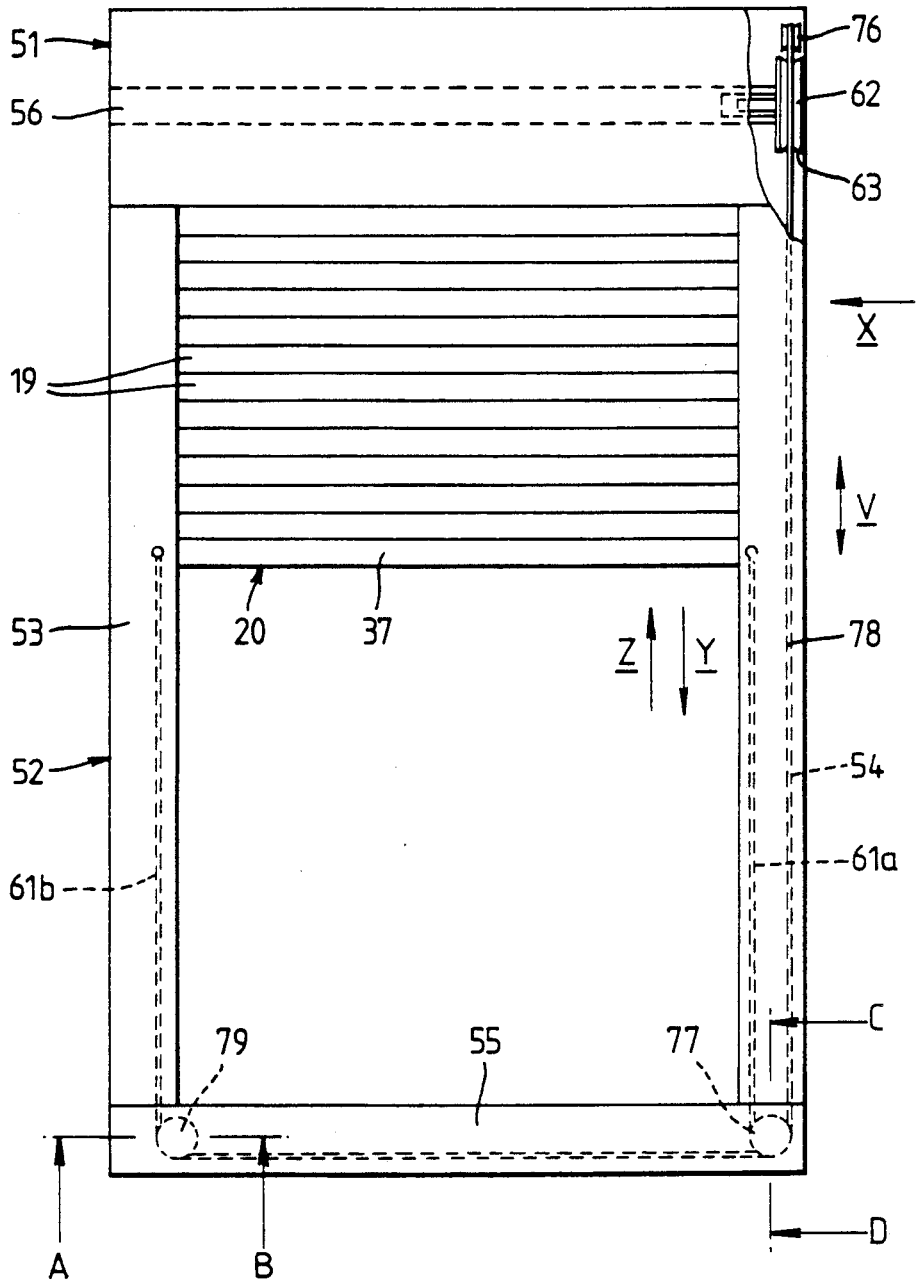
FIG. 9 is a schematic plan view of a rolling shutter in accordance with the present invention, with a second embodiment of the pulling device.
Figure 10:
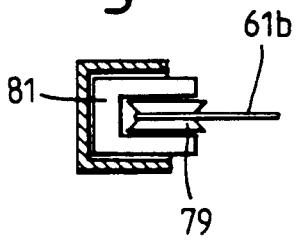
FIGS. 10 and 11 are views showing sections taken along the lines A–B and C–D in FIG. 9, on an enlarged scale.
Figure 11:
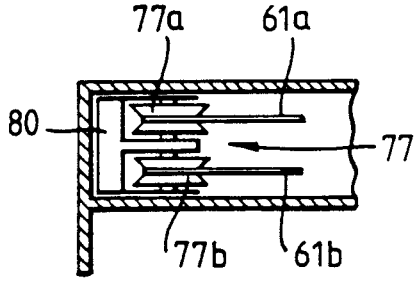

In the shown embodiment, especially FIGS. 9 and 12, one end of the pulling element 61 is connected with the initial portion of the disc 62 and partially wound on it. From there the pulling element 61 is guided over a first deviating element 76 to a second deviating element 77, and finally connected with another end on the front end bar 37 of the rolling shutter web 20. With the utilization of only one pulling element 61 the mounting is preferably performed contrary to FIG. 9 in the center of the end bar 37, to avoid canting under the action of pulling. Since in this case, the pulling element 61 would lie in the respective not covered window opening, the pulling element 61 is formed substantially at one point 78 in FIG. 9 as a two-part element. One part 61*a* is guided through the deviating element 77 to one end of the end bar 37, and another part 61*b* is guided over the deviating element 77 and a third deviating element 79 to the other end of the end part 37. The lengths of the parts 61*a* and 61*b* are selected so that during the displacement of the pulling element 61 parallel to the movement direction of the rolling shutter web 20 in accordance with the arrow v in FIG. 9, a canting-free movement of the end bar 37 is produced.

In accordance with FIGS. 9–13, the deviating elements 76 and 79 are formed preferably as grooved discs, while the deviating element 77 is composed of two grooved discs 77*a* and 77*b* arranged one above the other and holding the both parts 61*a* and 61*b* at a distance. The deviating elements 77 and 79 are suported in correspondence with FIG. 9 in both front corners of the frame shaped guiding body 52 composed of the side parts 53, 54 and the foot part 55. The first guiding element 76 is supported on one of the supports 51. When the grooved discs are used as deviating elements, they are preferably rotatably supported in bearing blocks 80 and 81 shown in FIGS. 10 and 11. The bearing blocks are preferably inserted in U-shaped guiding or foot parts 53, 54 or 55 or mounted in the supports 51.

The spring 64 in correspondence with FIG. 12 is arranged so that with immovable bearing pin 68 or rolling shutter shaft 56 it is tensioned by rotating the disc 62 in direction of the arrow w (clockwise direction) or with immovable disc 62 by rotation of the bearing pin 68 over the rolling shutter shaft 56 against the arrow w (counterclockwise direction). The deviating element 76 is arranged so that the portion of the pulling element 61 coming from it is wound during rotation of the disc 62 on it in counterclockwise direction as shown in FIG. 12, and is unwound from it during rotation of the disc 62 in clockwise direction. In FIG. 9 the winding of the pulling element 61 corresponds to a movement of the rolling shutter web 20 in direction of the arrow y (closing movement), in contrast the unwinding corresponds to the movement of the rolling shutter web 20 in direction of the arrow z (opening movement).

The operation of the above described pulling device is performed in correspondence with FIGS. 9 and 12 as follows:

In the opening position of the rolling shutter, the whole rolling shutter web 20 is wound on the rolling shutter shaft 56 and the pulling element 61 is unwound as far as possible from the disc 62. In this condition, the spring 64 is adjusted with a certain pre-tensioning, so that the disc 62 is urged to rotate relative to the movable rolling shutter shaft 56 in a counterclockwise direction. Thereby the pulling element 61 is tensioned. When now the rolling shutter shaft 56 is rotated against the arrow w for closing the rolling shutter in accordance with the arrow y in FIG. 9, the spring 64 acts for a further rotation of the disc 62 against the arrow w and thereby a winding of the pulling element 61, so that its tensioning is maintained. With sufficiently strong pre-tensioning of the spring 64, the lamellas 19 are also held at a distance from one another. This lasts until the front end bar 37 abuts against the foot part 55, and the pulling element 61 is wound as far as possible on the disc 62. When the rolling shutter shaft 56 is rotated somewhat further against the arrow w, the light gaps between the lamellas 19 are closed either under the action of the gravity force and/or under the action of the pulling cable 41 and the springs 42 in FIG. 6.

During subsequent opening of the rolling shutter by rotating the rolling shutter shaft 56 in direction of the arrow w, the opposite condition occurs. The force of the spring 64 holds the front end bar 37 first on the foot part 55, so that the lamellas 19 are pulled one from the other in direction of the arrow z in FIG. 9 and the light gaps are formed. Then the whole rolling shutter web 20 is positively wound in direction of the arrow z onto the rolling shutter web 56, and the end part 37 moves with it the pulling element 61 and gradually wound by the disc 62 which rotates thereby in direction of the arrow w in FIG. 12.

Both during the closing step and during the opening step of the rolling shutter, the rolling shutter shaft 56 and the disc 62 rotate in the same direction. A substantial difference is however that the rolling shutter shaft 56 runs in an unwinding step, while simultaneously the disc 62 performs a winding step, or vice versa.

The invention provides for the substantial advantage in that the outer diameter of the rolling shutter shaft 56 and the disc 62 can be selected with desired ratio for individual cases. When for example by corresponding dimensioning of the diameter of the disc 62 the diameter of the pulling element coil located on the disc 62 during completely open rolling shutter substantially corresponds to the diameter of the rolling shutter web coil located on the rolling shutter shaft 56, the disc 62 rotates during unwinding of the rolling shutter web 20 first substantially as fast as the rolling shutter shaft 56. Due to the gradually reduced diameter of the rolling shutter web coil and the constant or insignificantly increasing pulling element coil during closing of the rolling shutter, the roller shutter shaft 56 rotates faster as compared with the disc 62. Thereby the spring 64 is always pre-tensioned stronger until it reaches its highest pretensioning in the closed condition. This pre-tensioning can be selected so that the disc 62 during the mounting is turned relative to the rolling shutter shaft 56. During the utilization of the embodiment of FIG. 6 it is for example adjusted so that in the closed condition it applies a force which is greater than the force of the springs 42 and therefore during opening of the rolling shutter forms the light gaps which are advantageous for winding of the rolling shutter web. During opening of the rolling shutter this pretensioning is again gradually reduced. Alternatively any desirable pulling conditions can be selected especially such in that the pre-tensioned spring 64 is first substanially released during the closing step and then again strongly tensioned.

The invention provides for a further advantage in that the arrangement is selected so that the strongest pulling action is reached during abutting the front end bar 37 against the foot part 55 and is reduced during opening of the rolling shutter, and the turnable part of the rolling shutter requires no extension for receiving the pulling device and the front end of the guiding body 53 is not loaded by additional weight. Finally, it is advantageous that the above described pulling device can be used without structural changes for many different window sizes or rolling shutter lengths.

The invention is not limited to the above desribed embodiment which can be modified in many various ways. This is true especially for the type, construction and arrangement of the springs 42. For example, for the last pulling springs instead of pressure springs also arrangements with only one spring acting on both pulling cables 41 can be provided. Moreover, all above described features can be used for the invention individually or in various combinations. The pulling device 39 can be formed for example so that it performs the closing movement of the rolling shutter web 20 alone, or it supports the closing movement performed by the rolling shutter shaft 11. Instead of the pulling element 61 for example two completely separated cables or bands can be provided. Such separates cables or bands can cooperate with the same disc 62 or with two separate discs arranged on the same end or symmetrically at both ends of the rolling shutter shaft 56. Also, in such an embodiment the pulling elements, the deviating elements and the discs can be arranged invisibly in a rolling shutter box or in the guiding body 52. Moreover, the deviating elements can be formed differently and arranged at different locations, and also more or less deviating elements can be provided. Finally, the invention is not limited to the above described turnability of the side side walls 14 in FIGS. 2 and 3. They can be also connected with a conventional rolling shutter box and form with the latter a structural unit as a whole. Finally, the invention can be utilized with respective adjustment for vertical wall windows or doors with correspondingly tiltable blades.

It will be understood that each of the elements described above, or two or more together, may also find a useful application in other types of constructions differing from the types described above While the invention has been illustrated and described as embodied in a rolling shutter for wall or roof openings, especially in connection with a turnable roof window, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims

1. A rolling shutter for wall or roof openings, especially in connection with a turnable roof window, comprising a rolling shutter web composed of a plurality of rolling shutter elements pullable from one another for forming light gaps; a rolling shutter shaft for winding and unwinding of said rolling shutter web; supports for rotatably supporting said rolling shutter web; two parallel side walls connected with said supports for guiding lateral ends of said rolling shutter webs; an actuating device having a mechanism for an opening movement of the rolling shutter web and a pulling device engaging a free front end of said rolling shutter web and supporting or performing its closing movement, said rolling shutter elements including a front rolling shutter element and a rear rolling shutter element; a pulling rope connecting said front rolling shutter element and said rear shutter element, said pulling rope being fixedly connected with said rear rolling shutter element and being connected with said front rolling shutter element by means of a spring provided for closing of said light gaps, said spring having a force selected so that during starting an opening movement of said rolling shutter web at least said light gaps located between said front and rear rolling shutter elements are opened under the action of said pulling device and then said rolling shutter web is wound in an opening direction.

2. A rolling shutter as defined in claim 1, wherein said rolling shutter elements are formed as rolling shutter bars.

3. A rolling shutter as defined in claim 1, wherein said rolling shutter web has lateral ends connected with said pulling cable.

4. A rolling shutter as defined in claim 3; and further comprising ears provided on lateral ends of at least one of said rolling shutter elements, said pulling cable being slidingly guided in said ears.

5. A rolling shutter as defined in claim 1, wherein said front rolling shutter element has deviating elements for said pulling cable, said spring including at least one pulling and pressing spring arranged on the same one of said rolling shutter element and extending perpendicular to a movement direction of said rolling shutter web.

6. A rolling shutter as defined in claim 5, wherein said deviating elements are composed of deviating rollers which are rotatably supported on said front rolling shutter element.

7. A rolling shutter as defined in claim 1, wherein said pulling rope is formed as a wire cable.

8. A rolling shutter as defined in claim 4, wherein said ears are composed of hollow cylindrical sleeves.

9. A rolling shutter as defined in claim 1, wherein said pulling device includes a spring shaft.

10. A rolling shutter as defined in claim 9, and further comprising a foot part connecting the free end of said side parts, said spring shaft being rotatably supported in said foot part.

11. A rolling shutter as defined in claim 1, wherein said pulling device includes at least one pulling element mounted on a front end of said rolling shutter web and a winding element for said pulling element pre-tensioned by a spring, said winding element being formed as a disc which is coupled with an end of said rolling shutter shaft through said spring; and further comprising guiding parts and at least one deviating element arranged in the region of the front ends of said guiding parts for guiding said pulling elements to said front end of said rolling shutter web

12. A rolling shutter as defined in claim 11, wherein said pulling device has at each end of said rolling shutter shaft a disc coupled with said rolling shutter shaft through a spring and a pulling element; and guiding parts and a deviating element provided in the region of the front end of said guiding part and guiding said pulling element to said front end of said rolling shutter web.

13. A rolling shutter as defined in claim 11, wherein said pulling element is at least partially composed of two parts; and further comprising guiding parts and deviating elements arranged in the region of the front end of said guiding parts and connecting said parts of said pulling element with the front end of said rolling shutter web.

14. A rolling shutter as defined in claim 11, wherein said pulling element is composed of a pulling cable.

15. A rolling shutter as defined in claim 11, wherein said disc is formed as a grooved disc.

16. A rolling shutter as defined in claim 11, wherein said disc is rotatable on said rolling shutter shaft.

17. A rolling shutter as defined in claim 11; and further comprising a part connected with said rolling shutter shaft, said disc being supported on said part connected with said rolling shutter shaft.

18. A rolling shutter as defined in claim 11, wherein said disc has a hollow space, said spring being formed as a spiral spring and having one end connected with said rolling shutter shaft and another end connected with said disc.

19. A rolling shutter as defined in claim 18, wherein said hollow space surrounds said rolling shutter shaft, said one end of said spiral spring being directly connected with said rolling shutter shaft.

20. A rolling shutter as defined in claim 18; and further comprising a part connected with said rolling shutter shaft and rotatably supporting said disc, said hollow space surrounding said part, said one end of said spiral spring being connected with said part.

21. A rolling shutter as defined in claim 11, wherein said disc has a coil diameter which in all rolling shutter positions is greater than a coil diameter of said rolling shutter shaft.

22. A rolling shutter as defined in claim 11, wherein said disc has a coil diameter which with a fully open rolling shutter is smaller and with a fully closed rolling shutter is greater than an instantaneous coil diameter of said rolling shutter shaft.

23. A rolling shutter as defined in claim 11; and further comprising a part connected with said rolling shutter web and supporting said disc, said part being formed as a bearing pin, said disc having a hub supported in said bearing pin through ball bearings.

24. A rolling shutter as defined in claim 1, wherein said side parts have rear extensions; and further comprising a pivot pin extending parallel to said rolling shutter shaft, said extensions are turnably supported on said pivot pin, said actuating device being fixedly connected with said rolling shutter shaft.

25. A rolling shutter as defined in claim 24; and further comprising a guiding pin mountable on a window blade, at least one of said side parts having a guide which extends over its whole length and receives said guiding pin of the window blade.

* * * * *